US009617859B2

(12) United States Patent
Morgan et al.

(10) Patent No.: US 9,617,859 B2
(45) Date of Patent: Apr. 11, 2017

(54) TURBINE COMPONENTS WITH PASSIVE COOLING PATHWAYS

(71) Applicant: General Electric Company, Schenectady, NY (US)

(72) Inventors: Victor John Morgan, Simpsonville, SC (US); Stephen Gerard Pope, Roebuck, SC (US); Jacob Kittleson, Greenville, SC (US); Lawrence Matthew Levy, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 841 days.

(21) Appl. No.: 13/645,729

(22) Filed: Oct. 5, 2012

(65) Prior Publication Data

US 2014/0099183 A1 Apr. 10, 2014

(51) Int. Cl.
*F01D 5/14* (2006.01)
*F01D 5/18* (2006.01)

(52) U.S. Cl.
CPC ..... *F01D 5/18* (2013.01); *F01D 5/186* (2013.01); *F01D 5/187* (2013.01); *F05D 2230/10* (2013.01); *F05D 2230/50* (2013.01); *F05D 2300/611* (2013.01)

(58) Field of Classification Search
CPC ..... F01D 5/18
See application file for complete search history.

(56) References Cited

U.S. PATENT DOCUMENTS

| | | | | |
|---|---|---|---|---|
| 5,269,653 | A | 12/1993 | Evans | |
| 6,265,022 | B1 | 7/2001 | Fernihough et al. | |
| 6,478,537 | B2 * | 11/2002 | Junkin | 415/173.1 |
| 7,909,581 | B2 * | 3/2011 | Klein | C23C 14/042 416/241 B |
| 7,950,902 | B2 * | 5/2011 | Camhi | B23H 1/04 416/97 R |
| 8,574,671 | B2 * | 11/2013 | Ahmad et al. | 427/237 |
| 2006/0263217 | A1 * | 11/2006 | Spanks et al. | 416/97 R |

(Continued)

FOREIGN PATENT DOCUMENTS

| | | |
|---|---|---|
| EP | 1375825 A1 | 1/2004 |
| EP | 1655454 A1 | 5/2006 |

(Continued)

OTHER PUBLICATIONS

Search Report from EP Application No. 13187115.4 dated Jan. 27, 2014.

(Continued)

*Primary Examiner* — Gregory Anderson
*Assistant Examiner* — Jason Fountain
(74) *Attorney, Agent, or Firm* — Eversheds Sutherland (US) LLP

(57) ABSTRACT

The present application provides a turbine component for use in a hot gas path of a gas turbine. The turbine component may include an outer surface, an internal cooling circuit, a number of cooling pathways in communication with the internal cooling circuit and extending through the outer surface, and a number of adaptive cooling pathways in communication with the internal cooling circuit and extending through the outer surface. The adaptive cooling pathways may include a high temperature compound therein.

18 Claims, 3 Drawing Sheets

(56) References Cited

U.S. PATENT DOCUMENTS

| | | | | |
|---|---|---|---|---|
| 2007/0036942 | A1* | 2/2007 | Steele | 428/131 |
| 2011/0011563 | A1 | 1/2011 | Steele | |
| 2011/0070095 | A1* | 3/2011 | Harron | 416/96 R |
| 2011/0097188 | A1 | 4/2011 | Bunker | |
| 2011/0189015 | A1* | 8/2011 | Shepherd | F01D 5/186 416/95 |
| 2011/0241297 | A1 | 10/2011 | Morgan et al. | |
| 2012/0183412 | A1 | 7/2012 | Lacy et al. | |
| 2012/0189435 | A1 | 7/2012 | Morgan et al. | |

FOREIGN PATENT DOCUMENTS

| | | | |
|---|---|---|---|
| EP | 2354453 | A1 | 8/2011 |
| EP | 2716867 | A1 | 4/2014 |

OTHER PUBLICATIONS

U.S. Appl. No. 13/221,009, filed Aug. 30, 2011, Smith.
U.S. Appl. No. 13/409,341, filed Mar. 1, 2012, Ellis, et al.
U.S. Appl. No. 13/245,990, filed Sep. 27, 2011, Boyer, et al.
Cotronics Corporation; Title: "RESBOND 907GF" 2350 degrees Adhesive & Sealant, date: unknown; p. 1.
Title: High Temperature Ceramic-metallic Pastes; Technical Bulletin A3, Dated Jun. 2012, by Aremco Products, Inc.
Chinese Office Action dated Dec. 28, 2015 for Chinese Application No. 201310454042.8.

* cited by examiner

TURBINE COMPONENTS WITH PASSIVE COOLING PATHWAYS

TECHNICAL FIELD

The present application and resultant patent generally relate to gas turbine engines and more particularly relate to gas turbine components with adaptive cooling pathways such as cooling pathways filled with a compound that oxidizes, softens, changes volumetrically, and the like at a predetermined temperature for a supplemental cooling flow therethrough.

BACKGROUND OF THE INVENTION

Generally described, a gas turbine includes a number of stages with buckets extending outwardly from a supporting rotor disk. Each bucket includes an airfoil over which the hot combustion gases flow. The airfoil must be cooled to withstand the high temperatures produced by the combustion gases. Insufficient cooling may result in undo stress and oxidation on the airfoil and may lead to fatigue and/or damage. The airfoil thus is generally hollow with one or more internal cooling flow circuits leading to a number of cooling holes and the like. Cooling air is discharged through the cooling holes to provide film cooling to the outer surface of the airfoil. Other hot gas path components may be cooled in a similar fashion.

Although many models and simulations may be run before a given component is put into operation in the field, the exact temperatures to which a component or any area thereof may reach may vary greatly due to turbine hot and cold stretches. Temperature specific properties may be adversely affected by overheating. As a result, many turbine components may be overcooled to compensate for localized hotspots that may develop on the components. Such excess overcooling, however, may have a negative impact on overall gas turbine engine output and efficiency.

There is thus a desire for improved designs for airfoils and other types of hot gas path turbine components. Such improved designs may accommodate localized hotspots with a minimized amount of cooling air. Such improved designs also may promote extended component lifetime without compromising overall gas turbine efficiency and output.

SUMMARY OF THE INVENTION

The present application and the resultant patent thus provide a turbine component for use in a hot gas path of a gas turbine. The turbine component may include an outer surface, an internal cooling circuit, a number of cooling pathways in communication with the internal cooling circuit and extending through the outer surface, and a number of adaptive cooling pathways in communication with the internal cooling circuit and extending through the outer surface.

The present application and the resultant patent further provide a method of cooling a turbine component operating in a hot gas path. The method may include flowing a coolant through an internal cooling circuit, flowing the coolant through a number of cooling pathways in an outer surface, oxidizing a high temperature compound in one or more adaptive cooling pathways once a local predetermined temperature is reached, and flowing a supplemental volume of the air through the one or more adaptive cooling pathways.

The present application and the resultant further patent provide an airfoil component for use in a hot gas path of a gas turbine. The airfoil component may include an outer surface, a number of internal cooling circuits, a number of cooling pathways in communication with the internal cooling circuits and extending through the outer surface, and a number of adaptive cooling pathways in communication with the internal cooling circuits and extending through the outer surface. The adaptive cooling pathways may include a high temperature compound therein.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
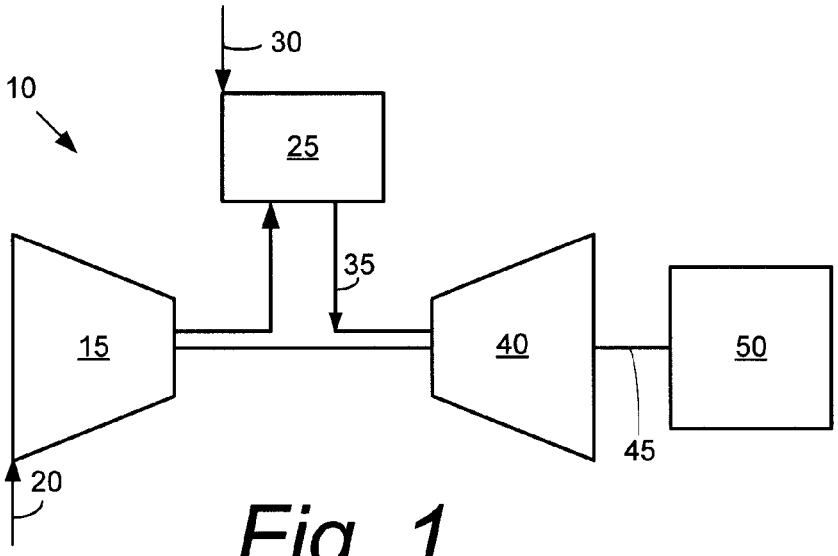
FIG. 1 is a schematic diagram of a gas turbine engine showing a compressor, a combustor, and a turbine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y. and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
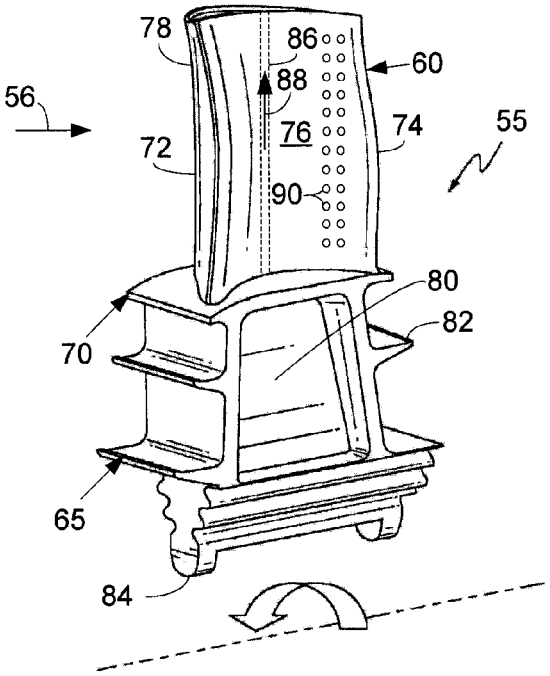
FIG. 2 is a perspective view of a known turbine bucket.

FIG. 2 shows an example of a turbine bucket 55 that may be used with the turbine 40 for use in a hot gas path 56. Generally described, the turbine bucket 55 includes an airfoil 60, a shank portion 65, and a platform 70 disposed between the airfoil 60 and the shank portion 65. The airfoil 60 generally extends radially upward from the platform 70 and includes a leading edge 72 and a trailing edge 74. The airfoil 60 also may include a concave surface defining a pressure side 76 and a convex surface defining a suction side 78. The platform 70 may be substantially horizontal and planar. The shank portion 65 may extend radially downward from the platform 70 such that the platform 70 generally defines an interface between the airfoil 60 and the shank portion 65. The shank portion 65 may include a shank cavity 80 therein. The shank portion 65 also may include one or more angle wings 82 and a root structure 84 such as a dovetail and the like. The root structure 84 may be configured to secure the turbine bucket 55 to the shaft 45. Other components and other configurations may be used herein.

The turbine bucket 55 may include one or more cooling circuits 86 extending therethrough for flowing a cooling medium 88 such as air from the compressor 15 or from another source. The cooling circuits 86 and the cooling medium 88 may circulate at least through portions of the airfoil 60, the shank portion 65, and the platform 70 in any order, direction, or route. Many different types of cooling circuits and cooling mediums may be used herein. The cooling circuits 86 may lead to a number of cooling holes 90 or other types of cooling pathways for film cooling and the like. Other components and other configurations also may be used herein.

Figure 3:
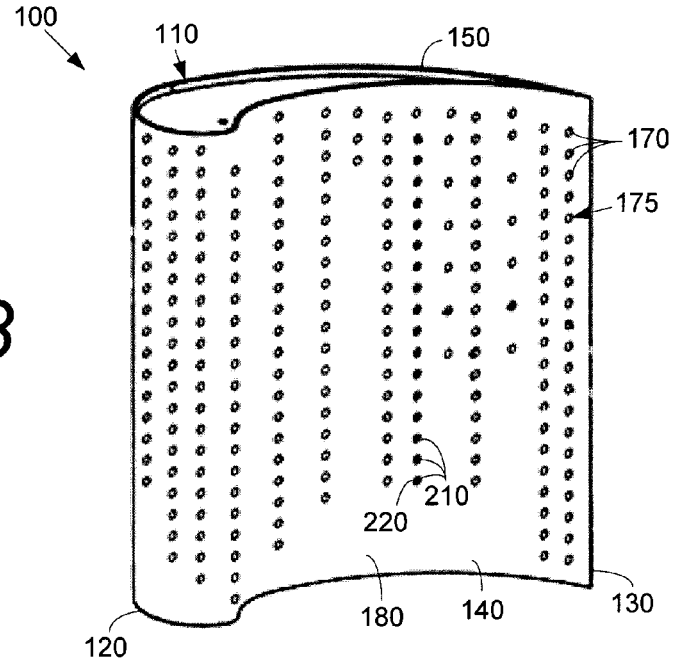
FIG. 3 is a perspective view of a portion of a turbine component as may be described herein.

FIG. 3 shows an example of a portion of a turbine component 100 as may be described herein. In this example, the turbine component 100 may be an airfoil 110 and more particularly a sidewall thereof. The airfoil 110 may be a part of a blade or a vane and the like. The turbine component 100 also may be any type of air-cooled component including a shank, a platform, or any type of hot gas path component. Other types of components and other configurations may be used herein.

Similar to that described above, the airfoil 110 may include a leading edge 120 and a trailing edge 130. Likewise, the airfoil 110 may include a pressure side 140 and a suction side 150. The airfoil 110 also may include one or more internal cooling circuits 160 therein. The cooling circuits 160 may lead to a number of cooling pathways 170 such as a number of cooling holes 175. The cooling holes 175 may extend through an outer surface 180 of the airfoil 110. The cooling circuits 160 and the cooling holes 175 serve to cool the airfoil 110 and the components thereof with a cooling medium 190 therein. Any type of cooling medium 190, such air, steam, and the like, may be used herein from any source. The cooling holes 175 may have any size, shape, or configuration. Any number of the cooling holes 175 may be used herein. Other types of cooling pathways 170 may be used herein. Other components and other configurations may be used herein.

Figure 4:
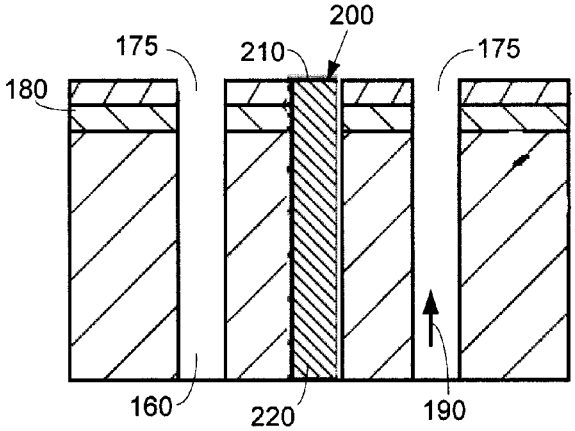
FIG. 4 is a side cross-sectional view of a portion of the turbine component of FIG. 3.
Figure 5:
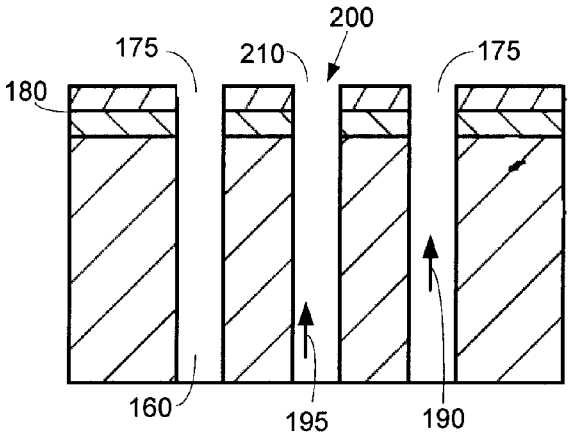
FIG. 5 is a side cross-sectional view of a portion of the turbine component of FIG. 3.

As is shown in FIGS. 4 and 5, the airfoil 110 also may include a number of adaptive cooling pathways 200. In this example, the adaptive cooling pathways 200 may be in the form of a number of adaptive cooling holes 210. The adaptive cooling holes 210 may extend through the outer surface 180 in a manner similar to the cooling holes 175. The adaptive cooling holes 210 also may be in communication with one or more of the cooling circuits 160. The adaptive cooling holes 210, however, may be filled with a high temperature compound 220. The high temperature compound 220 may be a binder with high temperature tolerant particles. The high temperature compound 220 may turn to ash or otherwise oxidize at a predetermined burnout temperature. The high temperature compound 220 also may soften (as opposed to liquefy) in a manner similar to molten glass. Further, the high temperature compound 220 also may change volumetrically, i.e., a negative coefficient of thermal expansion. Other types of processes also may be used herein.

Examples of the high temperature compound 220 include any type of compound used for high temperature adhesives, sealants, repair compounds, and the like. Such compounds may be metallic-ceramic compositions, other types of ceramic compositions, and other types of materials. Examples of such compounds include Resbond adhesives and sealants from Cotronics Corporation of Brooklyn, N.Y.; Pyro-Putty pastes available from Aremco Products, Inc. of Valley Cottage, N.Y.; M masking materials available from APV Engineered Coatings of Akron, Ohio; Pyrometric Cones available from Edward Orton Ceramic Foundation of Westerville, Ohio; and the like. The high temperature compound 220 may plug and block the adaptive cooling holes 210 until the local burnout temperature may be reached. The high temperature compound 220 may then turn to ash or otherwise oxidize, soften, change volumetrically, and the like. The pressure differential across the adaptive cooling hole 210 may then blow the ash out of the adaptive cooling hole 210 so as to allow a supplemental volume 195 of the cooling medium 190 to flow therethrough and cool the outer surface 180.

Figure 6:
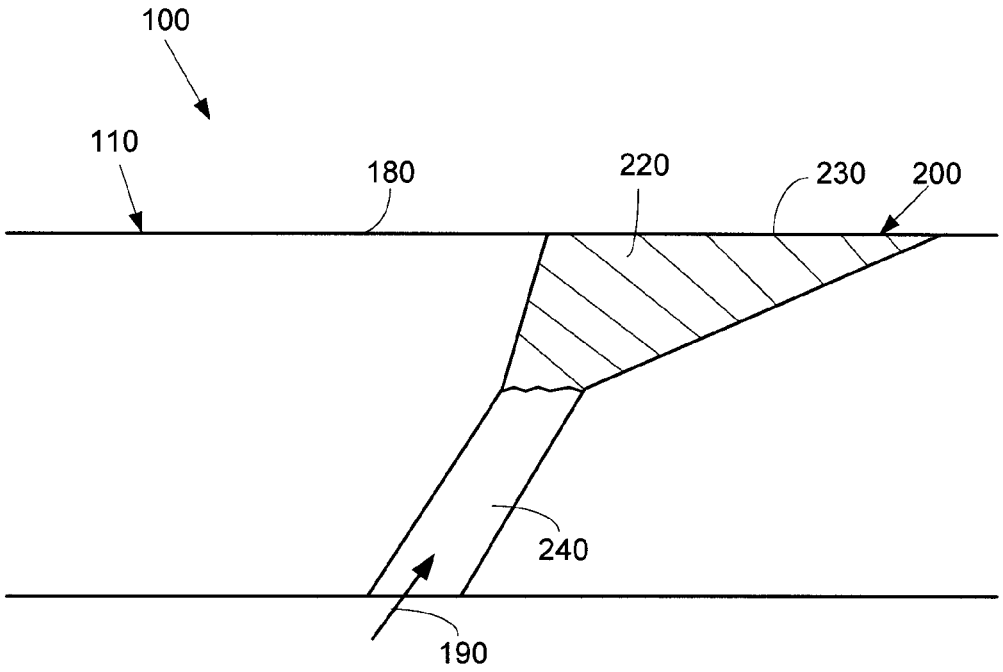
FIG. 6 is a side cross-sectional view of a portion of an alternative embodiment of a turbine component as may be described herein.
Figure 7:
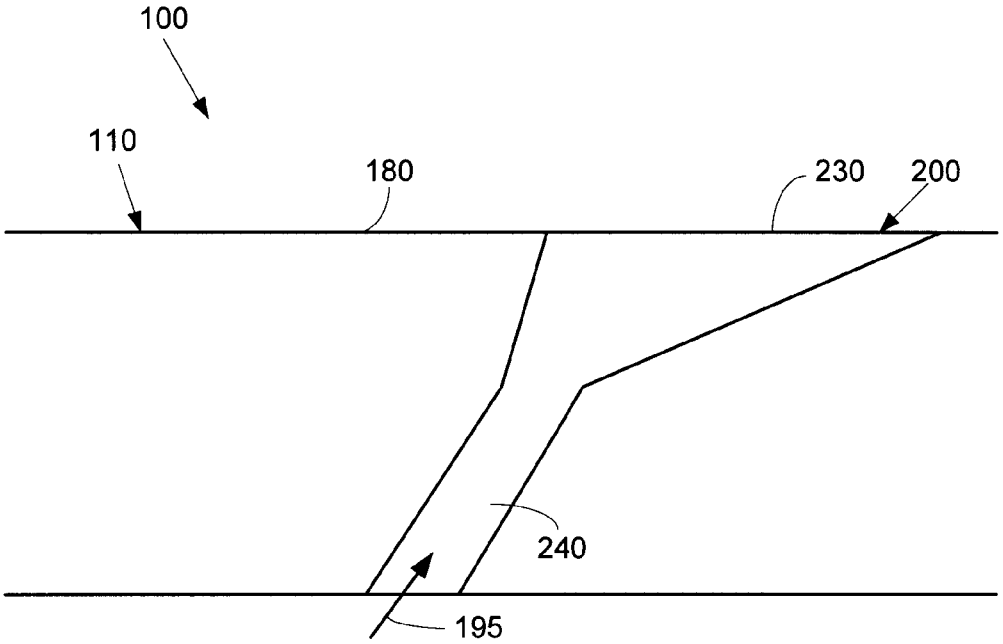
FIG. 7 is a side cross-sectional view of a portion of the turbine component of FIG. 6.

FIGS. 6 and 7 show a further example of the adaptive cooling pathway 200. In this example, the adaptive cooling pathway 200 may take the form of an adaptive cooling trench 230. The adaptive cooling trench 230 may be in communication with one or more adaptive cooling trench holes 240. The adaptive cooling trench 230 may be positioned about the airfoil 110 or about other types of the turbine components 100. The adaptive cooling trench 230 may have any size, shape, or configuration. Any number of the adaptive cooling trenches 230 may be used. Likewise, the adaptive cooling trench holes 240 may have any size, shape, or configuration. The adaptive cooling trench 230 may be filled in whole or in part with the high temperature component 220. As above, the high temperature compound 220 may burn off or otherwise oxidize, soften, or change volumetrically when the predetermined burnout temperature may be reached so as to open the adaptive cooling trench hole 240 as well as all or part of the adaptive cooling trench 230 for the supplemental volume 195 of the cooling medium 190. Other components and other configurations also may be used herein.

In use, the turbine component 100 such as the airfoil 110 may be drilled to provide the cooling pathways 170 such as the cooling holes 175 and other types of cooling features. The turbine component 100 may be coated with a thermal barrier coating. The adaptive cooling pathways 200 then may be filled with the high temperature compound 220. The turbine component 100 then may be put into operation. If the turbine component 100 or a localized hotspot thereon were to exceed the burnout temperature of the high temperature compound 220, the high temperature compound 220 would burn out or otherwise oxidize so as to open the adaptive cooling pathway 200 and allow the supplemental volume 195 of the cooling medium 190 to cool the component 100 and eliminate or at least reduce the impact of the hotspot.

The use of the adaptive cooling pathways 200 thus allows the turbine component 100 to adapt to the overall operating conditions of the gas turbine 10. If the turbine component 100 or areas thereof are hotter than predicted, then the adaptive cooling pathways 200 allow for the supplemental volume 195 of the cooling medium 190 so as to mitigate problems such as spallation and oxidation or other deleterious high temperature effects.

The adaptive cooling pathways 200 also allow for a minimized use of the cooling medium 190. Specifically, the adaptive cooling pathways 200 will be opened for the supplemental volume 195 only once the turbine component 100 or an area thereof reaches the specified burn out temperature. As such, the adaptive cooling pathways 200 may lead to a reduction in design time and a decrease in field variation. The overall lifetime of the turbine component 100 also should be increased. Specifically, the number of intervals that the component 100 may operate may be increased. Likewise, the amount of the cooling medium 190 may be reduced in that only the required adaptive cooling pathways 200 may be opened for the supplemental volume 195 of the cooling medium. Moreover, new cooling strategies may be employed given the lack of concern with overheating.

The present application also allows for testing of cooled components with the intent of ascertaining heating and cooling patterns to be utilized in improved designs. Activation of adaptive cooling would allow for iterative and improved utilization of the cooling medium in subsequent components.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A turbine component for use in a hot gas path of a gas turbine, comprising:

an outer surface;

an internal cooling circuit;

a plurality of cooling pathways in communication with the internal cooling circuit, wherein the plurality of cooling pathways comprises inner walls that define a hollow portion of the plurality of cooling pathways;

a plurality of cooling trenches in communication with the plurality of cooling pathways and the outer surface, wherein the plurality of cooling trenches comprises a conical portion; and a high temperature compound positioned in and adhered to walls forming the plurality of cooling trenches such that the plurality of cooling trenches is at least partially filled, wherein the high temperature compound blocks a path from an end of the hollow portion of the plurality of cooling pathways to the outer surface, and wherein the plurality of cooling pathways is void of the high temperature compound, the high temperature compound configured to blowout of the conical portion at a predetermined burnout temperature.

2. The turbine component of claim 1, wherein the turbine component comprises an airfoil.

3. The turbine component of claim 2, wherein the airfoil comprises a blade or a vane.

4. The turbine component of claim 1, wherein the plurality of cooling pathways comprises a plurality of cooling holes with a cylindrical configuration.

5. The turbine component of claim 1, wherein the high temperature compound turns to ash at the predetermined burnout temperature.

6. The turbine component of claim 1, wherein the high temperature compound is configured to blowout due to a pressure differential across the plurality of cooling trenches.

7. The turbine component of claim 1, wherein the plurality of cooling pathways comprises a plurality of adaptive cooling holes.

8. The turbine component of claim 1, further comprising a cooling medium flowing through the internal cooling circuit.

9. The turbine component of claim 8, wherein the cooling medium flows through the plurality of cooling pathways.

10. The turbine component of claim 8, further comprising a supplemental volume of the cooling medium and wherein the supplement volume of the cooling medium flows through the plurality of cooling pathways once a local predetermined temperature is reached.

11. The turbine component of claim 1, wherein the turbine component comprises a shank.

12. The turbine component of claim 1, wherein the conical portion is oriented such that a volume of the conical portion increases from the hollow portion to the outer surface.

13. The turbine component of claim 1, wherein a first number of the plurality of cooling pathways is equal to a second number of the plurality of cooling trenches.

14. A method of cooling a turbine component operating in a hot gas path, comprising:

flowing a coolant through an internal cooling circuit;

flowing the coolant through a plurality of cooling pathways in an outer surface, wherein the plurality of cooling pathways comprises inner walls that define a hollow portion of the plurality of cooling pathways;

blocking a path from the internal cooling circuit to the outer surface with a high temperature compound, wherein the high temperature compound is positioned such that a plurality of cooling trenches is at least partially filled, and wherein the plurality of cooling pathways is void of the high temperature compound;

heating the high temperature compound in a conical portion of one or more adaptive cooling trenches once a local predetermined temperature is reached;

creating a pressure differential across the one or more adaptive cooling trenches;

ashing out the high temperature compound; and flowing a supplemental volume of the air through the one or more cooling pathways.

15. An airfoil component for use in a hot gas path of a gas turbine, comprising:

an outer surface;

a plurality of internal cooling circuits;

a plurality of cooling pathways in communication with the plurality of internal cooling circuits, wherein the plurality of cooling pathways is hollow and comprises inner walls that define a hollow portion of the plurality of cooling pathways; and a plurality of adaptive cooling trenches in communication with the plurality of cooling pathways and extending through the outer surface wherein the plurality of cooling trenches comprises a conical portion at least partially filled with a high temperature compound that blocks a path from the internal cooling circuit to the outer surface, and wherein the plurality of cooling pathways is void of the high temperature compound, the high temperature compound configured to pop out of the conical portion at a predetermined burnout temperature.

16. The airfoil component of claim 15, wherein the high temperature compound oxidizes at a predetermined temperature.

17. The airfoil component of claim 15, wherein the high temperature compound softens or changes volumetrically at a predetermined temperature.

18. The airfoil component of claim 15, further comprising a cooling medium flowing through the plurality of cooling pathways and further comprising a supplemental volume of the cooling medium flowing through the plurality of adaptive cooling trenches once a local predetermined temperature is reached.

* * * * *